US007562645B2

(12) United States Patent
Lichti et al.

(10) Patent No.: US 7,562,645 B2
(45) Date of Patent: Jul. 21, 2009

(54) ELECTROMECHANICAL CAMSHAFT PHASER HAVING A WORM GEAR DRIVE WITH A HYPOID GEAR ACTUATOR

(75) Inventors: Thomas H. Lichti, Victor, NY (US); Daniel R. Cuatt, Rush, NY (US)

(73) Assignee: Delphi Technologies, Inc., Troy, MI (US)

( * ) Notice: Subject to any disclaimer, the term of this patent is extended or adjusted under 35 U.S.C. 154(b) by 176 days.

(21) Appl. No.: 11/881,915

(22) Filed: Jul. 30, 2007

(65) Prior Publication Data

US 2009/0031974 A1 Feb. 5, 2009

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 5,156,119 A 10/1992 Suga
5,680,837 A * 10/1997 Pierik ..... 123/90.17

FOREIGN PATENT DOCUMENTS

| | | |
|---|---|---|
| DE | 4040486 | 1/1992 |
| DE | 19951392 | 5/2001 |
| EP | 1136658 | 9/2001 |
| EP | 1338761 | 8/2003 |
| EP | 1801367 | 6/2007 |

OTHER PUBLICATIONS

European Search Report dated Dec. 17, 2008.

* cited by examiner

*Primary Examiner*—Zelalem Eshete
(74) *Attorney, Agent, or Firm*—Thomas N. Twomey

(57) ABSTRACT

An electromechanical camshaft phasing system comprising a first pinion gear mounted on the end of an engine camshaft and engaged by a worm gear mounted on a transverse shaft extending from and journalled by bearings in a phaser drive sprocket to cause the camshaft to rotate in response to the engine crankshaft. The first pinion gear is surrounded by a ring gear having a hub keyed to an armature or stator shaft of a motor mounted on the engine coaxially of the camshaft and first pinion gear. A second pinion gear mounted on the worm gear shaft engages the ring gear such that motor rotation of the ring gear about the first pinion gear causes rotation of the second pinion gear, worm gear, first pinion gear, and thus the camshaft with respect to the sprocket, thus varying the phase of the camshaft with respect to the crankshaft.

11 Claims, 4 Drawing Sheets

ELECTROMECHANICAL CAMSHAFT PHASER HAVING A WORM GEAR DRIVE WITH A HYPOID GEAR ACTUATOR

TECHNICAL FIELD

The present invention relates to camshaft phasers for varying the valve actuation timing of compression valves in an internal combustion engine; more particularly, to an electromechanically-actuated camshaft phaser system having a worm gear drive; and most particularly, to such a phaser system wherein the worm gear is itself driven by a hypoid/ring gear train.

BACKGROUND OF THE INVENTION

Camshaft phasers for controllably varying the actuation timing of engine compression valves are well known. At present, most prior art camshaft phasers in production by or for engine manufacturers are vane-type phasers having interlocked rotors and stators. The phase relationship between the rotor and the stator may be varied by varying the relative oil volume on one side or the other of interlocked vanes via a four-way oil control valve.

Vane phasers are compact and relatively inexpensive. However, they have difficulty operating rapidly or with precision at times of low oil pressure because phasers typically are powered by parasitic use of pressurized engine lubricating oil. When the engine is idling, or is very hot, or at engine start-up, or combinations of these conditions, engine oil pressure can be very low or substantially non-existent, resulting in poor phasing control and excessive engine emissions.

What is needed in the art is a camshaft phaser system wherein phasing is achieved electromechanically without reliance on engine oil pressures.

It is a principal object of the present invention to provide camshaft phasing without resort or regard to engine oil pressures to improve engine emissions control.

SUMMARY OF THE INVENTION

Briefly described, an electromechanical camshaft phasing system in accordance with the invention comprises a first pinion gear mounted on the end of an engine camshaft. The first pinion gear is engaged by a worm gear mounted on a transverse shaft extending from and journalled in a phaser drive sprocket for a drive chain or a toothed wheel for a toothed drive belt to rotate the camshaft in response to the engine crankshaft. The first pinion gear is surrounded by a ring gear driven by an armature or stator of a motor mounted on the engine coaxially of the camshaft and first pinion gear. A second pinion gear mounted on the worm gear shaft engages the ring gear such that motor rotation of the ring gear causes rotation of the second pinion gear, worm gear, first pinion gear, and thus the camshaft with respect to the sprocket, thus varying the phase of the camshaft with respect to the crankshaft.

BRIEF DESCRIPTION OF THE DRAWINGS

The present invention will now be described, by way of example, with reference to the accompanying drawings, in which.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
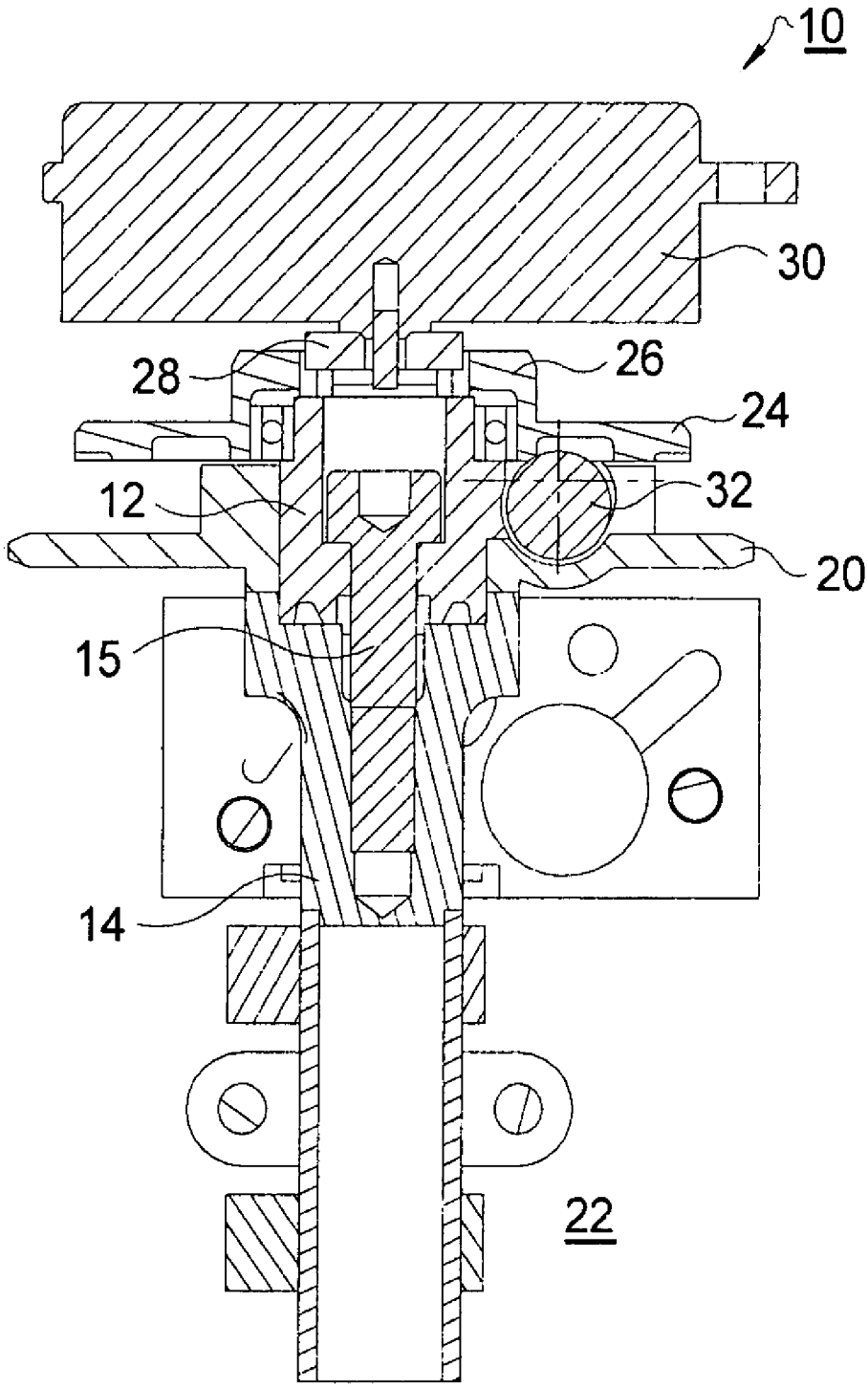
FIG. 1 is a longitudinal cross-sectional view of a camshaft phaser in accordance with the invention mounted on the end of a camshaft in an internal combustion engine.
Figure 2:
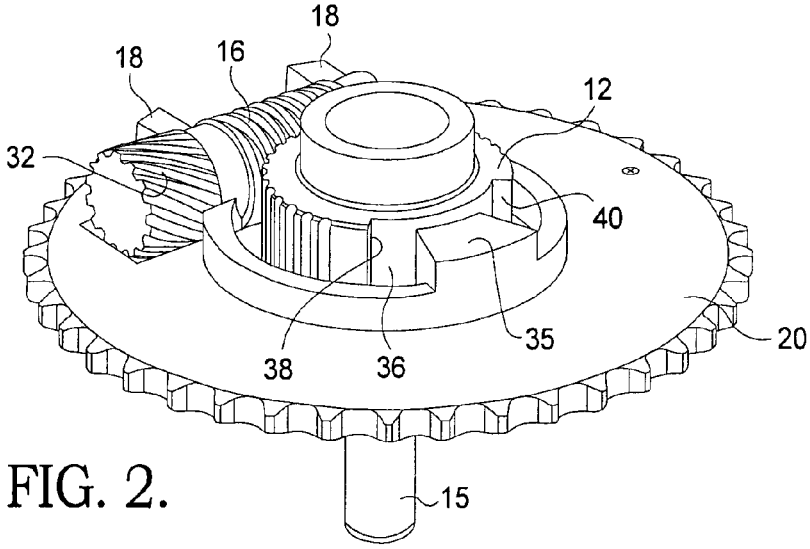
FIG. 2 is an isometric view showing a first sub-assembly of the camshaft phaser shown in FIG. 1, showing a phasing pinion gear driven by a composite worm gear and hypoid pinion gear mounted on a sprocket gear.
Figure 3:
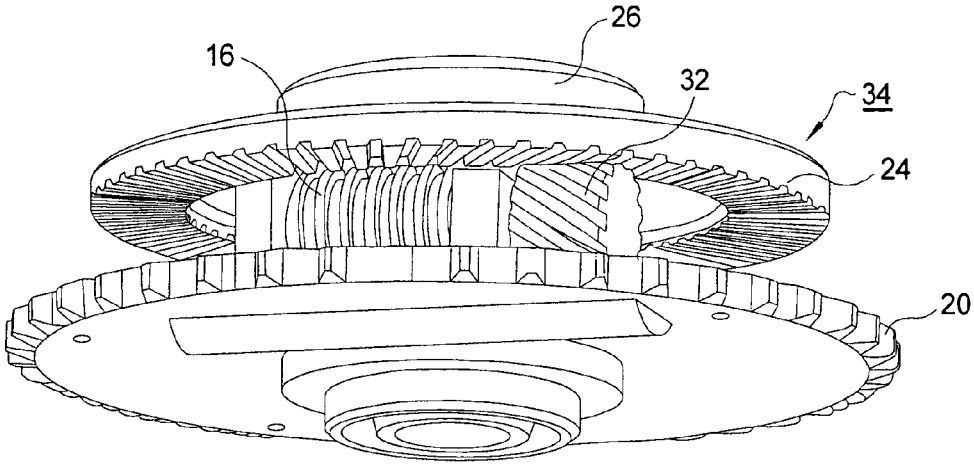
FIG. 3 is a first isometric view showing of a second sub-assembly, showing a ring gear added to the first sub-assembly and engaged with the hypoid pinion gear.
Figure 4:
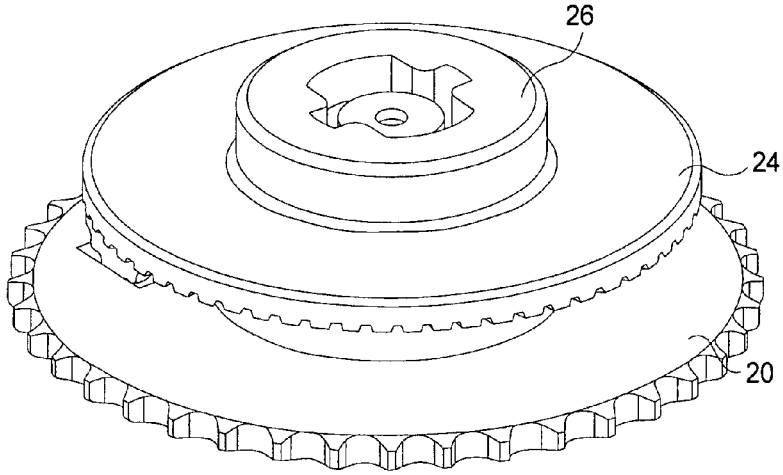
FIG. 4 is a second isometric view from above of the second sub-assembly shown in FIG. 3.
Figure 5:
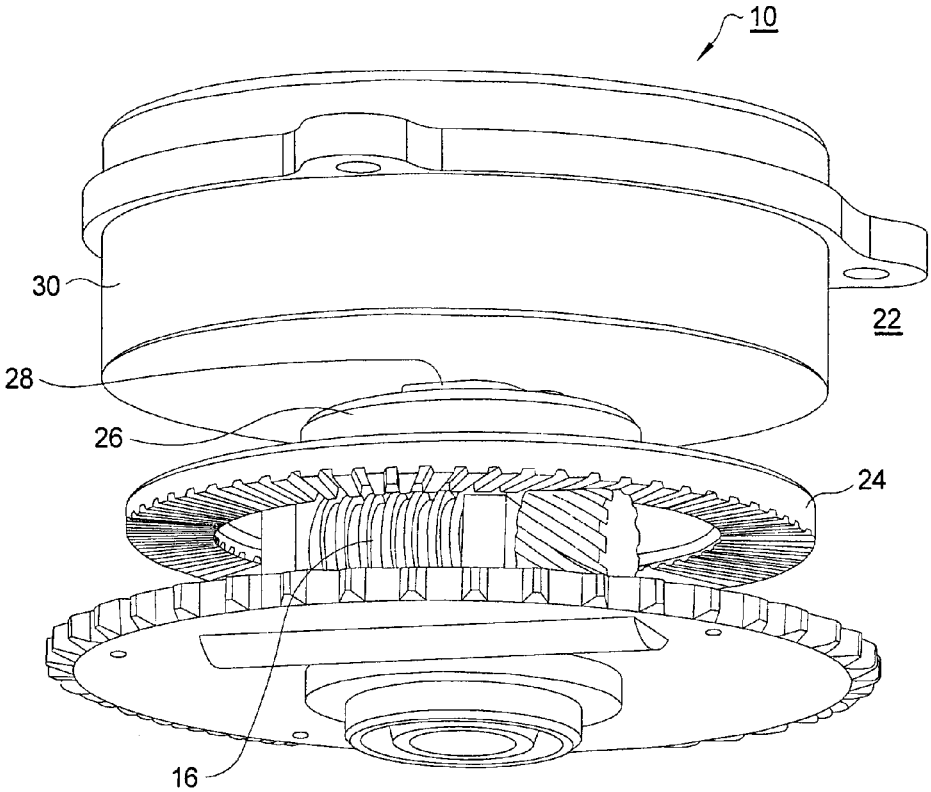
FIG. 5 is an isometric view of a complete camshaft phaser in accordance with the invention showing a scotch yoke geometry on the ring gear; and, FIG. 6 is an isometric view showing the phaser of FIG. 5 mounted to a first camshaft, and a conventional vane-type phaser mounted to a second camshaft for being driven by a common timing chain.

The present invention is directed to an electromechanical camshaft phaser comprising a phasing worm gear driven by a hypoid/ring gear drive train. The worm gear drive is an important improvement on prior art phasers as the worm/pinion gear is essentially self-locking: camshaft torque reversals cannot back-drive the worm gear as happens in oil-actuated prior art vane-type phasers, thus providing good positional stability of the phaser. Further, this arrangement minimizes the number of interfaces from which manufacturing and operational clearances and tolerances may accumulate to create angular lash, which lash results in audible noise. In the present invention, only lash in the worm/pinion gear and lash in the worm gear bearing support can contribute to lash noise. This arrangement further minimizes potential loading of the electric drive motor for the worm gear drive.

Referring to FIGS. 1-6, an electromechanical camshaft phasing system 10 in accordance with the invention comprises a first phasing pinion gear 12 mounted on the end of an engine camshaft 14, for example, by bolt 15. First pinion gear 12 is engaged by a worm gear 16 mounted on a transverse shaft journalled by bearings 18 in a phaser drive sprocket 20 that is conventionally rotatable by a timing chain or belt (not shown) driven by a crankshaft (not shown) of an internal combustion engine 22 to which camshaft 14 is mounted, thus driving camshaft 14 in response to the engine crankshaft. A ring gear 24 includes a hub 26 keyed to a drive shaft 28 of a driver motor 30, such as for example, an electric motor, mounted on engine 22 coaxially of camshaft 14 and first pinion gear 12. A second hypoid pinion gear 32 mounted on the shaft of worm gear 16 engages ring gear 24 defining a hypoid reduction gear train 34 such that energizing of the electric motor 30 as shown causes ring gear 24 to rotate about first pinion gear 12 in either rotational direction, depending upon polarity of the current being supplied to motor 30. Such rotation of ring gear 24 causes rotation of second pinion gear 32 and hence worm gear 16, causing first pinion gear 12 and camshaft 14 to be rotated with respect to sprocket 20, thus varying the phase of the camshaft with respect to the crankshaft.

In a presently preferred embodiment, sprocket 20 includes a tang 35 extending radially inwards into a gap 36 in the teeth of first pinion gear 12, defining first and second rotation limiting stops 38,40 for first pinion gear 12. Preferably, second pinion gear 32 is of the known "single-enveloping" type (not shown) wherein the diameter of the hypoid gear flights is progressive to enable greater contact area with the teeth of ring gear 24. Preferably, worm gear 16 is also a known enveloping-type (not shown) gear, either single-enveloping or double-enveloping, again to enable contact with the teeth of first pinion gear 12 over a broad central angle (number of teeth) of gear 12.

Note that in an alternative second embodiment (not shown), the shaft that supports worm gear 16 and second pinion gear 32 may be fixed in sprocket 20 rather than journalled for rotation, and worm gear 16 and second pinion gear 32 may be mounted on a sleeve that is rotatable upon the shaft, to equal effect as in the first embodiment described above. The overriding consideration is simply that worm gear 16 be rotationally coupled to second pinion gear 32, whatever the supporting structure.

Figure 6:
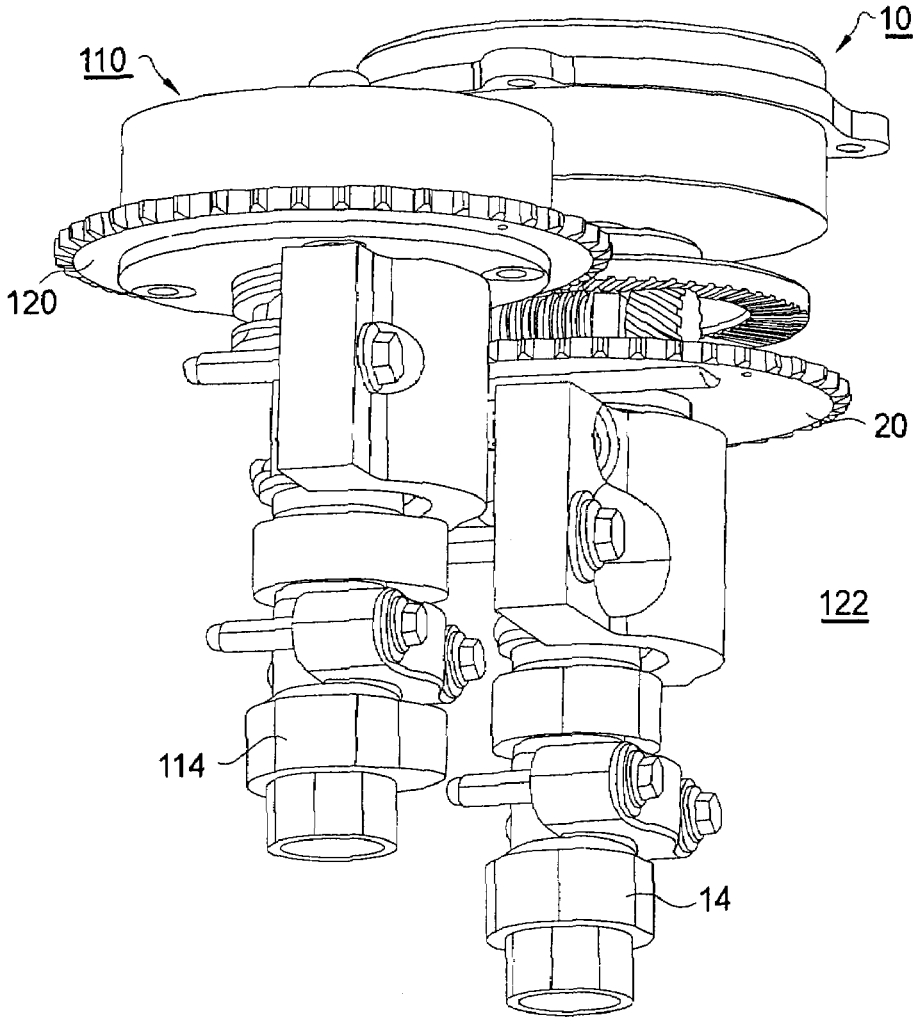

Referring to FIG. 6, an electromechanical camshaft phaser 10 in accordance with the invention may be readily incorporated on a first camshaft 14 in a dual camshaft engine 122 wherein a second camshaft 114 is provided with either a similar electromechanical phaser or with a conventional vane-type phaser 110. The sprockets 20,120 of the phasers may be driven in time by a common drive chain (not shown). Of course, the second camshaft may have a phaser of any type or no phaser, and the electromechanical phaser may be applied to intake, exhaust or on both camshafts, or to a single camshaft engine wherein the camshaft drives intake and exhaust valves. Note further that the position of the second pinion gear 32, worm gear 16, and teeth on first pinion gear 12 can be changed to the opposite side of the phaser axis to change the default position (advance or retard) that obtains if motor 30 is used for braking.

An electrically driven phaser in accordance with the invention may be applied to either an intake or an exhaust camshaft. It is most advantageous to apply the invention to the intake camshaft, as a major advantage is to enable repositioning of the intake cam during engine cranking (prior to any oil pressure being available) to obtain the optimal cam timing based on the temperature conditions of the engine. Once the engine fires, the cam timing can also be adjusted as needed during the first couple of seconds of engine run time to minimize emissions. This is a significant advantage over engines equipped with prior art oil-actuated phasers because a large portion of engine emissions occurs in the first few seconds of engine run time when the fuel/air mixture is quite rich and combustion is not yet running smoothly. As noted above, this is not possible to do with an oil-actuated phaser because sufficient oil pressure typically is not available for several seconds after engine start. Adjusting the intake cam during this period not only gives superior emissions control via valve timing overlap but also provides the additional advantage of influencing relative compression ratio.

Also, in accordance with the invention, the electric motor 30 can be operated in a motor mode, spinning the ring gear 24 faster (ahead of) than the rotational speed of the pinion gear 12, or in a generator mode (braking mode) spinning ring gear 24 slower (behind) than the rotational speed of pinion gear 12. Further, the hand (right or left hand) of the gearing can be reversed as suitable for either intake camshaft or exhaust camshaft applications so as to preferably move the phaser either towards advance or towards retard timing.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A camshaft phaser system for varying the phase relationship between a crankshaft and camshaft in an internal combustion engine, comprising:

a) a first pinion gear mounted coaxially on said camshaft;

b) a phaser drive sprocket supported for rotation about said camshaft and drivable by said crankshaft;

c) a worm gear supported for rotation by said phaser drive sprocket and engaged with said first pinion gear for rotating said camshaft in a phase relationship with said crankshaft;

d) a second pinion gear rotatable with said worm gear;

e) a ring gear engaged with said second pinion gear; and f) a driver, wherein said driver is connected to said ring gear for driving rotation of said ring gear, and wherein movement of said driver causes said ring gear to be rotated relative to said first pinion gear, and wherein said rotation of said ring gear causes said second pinion gear, said worm gear, and said first pinion gear to be rotated with respect to said phaser drive sprocket to change said phase relationship between said camshaft and said crankshaft.

2. A camshaft phaser system in accordance with claim 1 wherein said driver is an electric motor.

3. A camshaft phaser system in accordance with claim 1 wherein said first pinion gear includes an angular gap in the gear teeth thereof, and wherein said phaser drive sprocket includes a tang disposed within said angular gap to define a rotation stop for said first pinion gear.

4. A camshaft phaser system in accordance with claim 1 wherein said worm gear is of the single-enveloping type.

5. A camshaft phaser system in accordance with claim 1 wherein said worm gear is of the double-enveloping type.

6. A camshaft phaser system in accordance with claim 1 wherein said second pinion gear is of the single-enveloping type.

7. A camshaft phaser system in accordance with claim 1 wherein said worm gear and said second pinion gear are fixed to said shaft, and wherein said shaft is journalled for rotation in said phaser drive sprocket.

8. A camshaft phaser system in accordance with claim 1 wherein said shaft is fixed in said phaser drive sprocket, and wherein said worm gear and said second pinion gear are mounted for rotation on said shaft.

9. An electromechanical camshaft phaser system in accordance with claim 2 wherein electrical energizing of said motor causes said ring gear to rotate and wherein a polarity of said electrical energizing may be reversed, permitting said ring gear to be driven in either rotation direction with respect to said camshaft, thus causing the camshaft phase with respect to said crankshaft to be either advanced or retarded in response to said energizing polarity.

10. An electromechanical camshaft phaser system in accordance with claim 1 wherein said phaser drive sprocket is selected from the group consisting of a sprocket for driving via a chain and a toothed wheel for driving via a toothed belt.

11. An internal combustion engine comprising a camshaft phaser system for varying the phase relationship between an engine crankshaft and an engine camshaft, wherein said phaser system includes, a first pinion gear mounted coaxially on said camshaft, phaser drive sprocket supported for rotation about said camshaft and drivable by said crankshaft, a worm gear supported for rotation by said phaser drive sprocket and engaged with said first pinion gear for rotating said camshaft in a phase relationship with said crankshaft, a second pinion gear rotatable with said worm gear, a ring gear engaged with said second pinion gear, and a driver mounted on said engine, wherein said driver is connected to said ring gear for driving rotation of said ring gear, and wherein movement of said driver causes said ring gear to be rotated relative to said first pinion gear, and wherein said rotation of said ring gear causes said second pinion gear, said worm gear, and said first pinion gear to be rotated with respect to said phaser drive sprocket to change said phase relationship between said camshaft and said crankshaft.

* * * * *